US005315852A

United States Patent [19]

Talley et al.

[11] Patent Number: 5,315,852

[45] Date of Patent: May 31, 1994

[54] ROTARY DRAW BENDING APPARATUS AND METHOD

[75] Inventors: Laroul J. Talley, Brookston; Gary L. English, Paris, both of Tex.

[73] Assignee: The Babcock & Wilcox Company, New Orleans, La.

[21] Appl. No.: 84,909

[22] Filed: Jul. 2, 1993

[51] Int. Cl.[5] ..... B21D 7/04

[52] U.S. Cl. ..... 72/149; 72/159

[58] Field of Search ..... 72/149, 154, 159

[56] References Cited

U.S. PATENT DOCUMENTS

| | | | |
|---|---|---|---|
| 2,812,004 | 11/1957 | Huet | 72/154 |
| 3,242,710 | 3/1966 | Hamlin | 72/159 |
| 3,303,683 | 2/1967 | Schmidt | 72/154 |
| 4,959,984 | 10/1990 | Trudell et al. | 72/154 |

FOREIGN PATENT DOCUMENTS

| | | | |
|---|---|---|---|
| 0042551 | 11/1978 | Japan | 72/149 |
| 0122622 | 5/1989 | Japan | 72/149 |
| 2177035 | 1/1987 | United Kingdom | 72/159 |

*Primary Examiner*—David Jones

*Attorney, Agent, or Firm*—Robert J. Edwards

[57] ABSTRACT

A rotary die pipe bending apparatus comprising a bend die mounted for rotation about a bending axis and a clamp die for clamping a pipe to the bend die. The clamp die holds the pipe to be bent as the bend die and the clamp die rotate about the bending axis. A pressure die directed against an outer surface of the pipe for restraining a portion of the pipe spaced away from the bend to be formed in the pipe. A reverse die engaged with an inner surface of the pipe at a location spaced away from the clamp and bend dies and near the pressure die for resisting the bowing of the pipe in back of the bend die and for avoiding the formation of an indentation at the end of the bend.

2 Claims, 2 Drawing Sheets

ROTARY DRAW BENDING APPARATUS AND METHOD

FIELD AND BACKGROUND OF THE INVENTION

The present invention relates in general to pipe bending and, in particular, to a new and useful rotary draw bending apparatus and method which avoids the formation of indentations or humps in the pipe at the end of the bend and resists the bowing of the pipe in back of the bend die, resulting from the application of excessive force on the pressure die.

The technique of rotary draw bending derives its name from the concept of a pipe or tube being clamped, held and rotated around a bend die. During the process, the pipe is pulled or drawn forward. This is different from the so-called compression bending where the pipe is stationary and is wrapped around a form. The minimum tools or dies required for rotary draw bending are a clamp die, a bend die, and a pressure die. The clamp die holds the pipe or tube against the bend die and rotates with the bend die. The pressure die holds back reaction forces to create the bend. All bending occurs within a narrow zone just prior to and slightly following the point where the pressure die is tangent to the bend die. It is within this range that the yield point of the pipe or tube material is exceeded thereby forming indentations or humps.

The machine operators are known to apply excessive force on the pressure die in an attempt to improve the ovality of the tube or pipe within the bend. The application of excessive force may cause the formation of indentations or humps in the pipe at the end of the bend and may cause the pressure die to over travel and actually bow the pipe in back of the bend die. The present invention avoids the formation of indentations or humps in the pipe at the end of the bend and resists the bowing of the pipe in back of the bend die, resulting from the application of excessive force on the pressure die.

SUMMARY OF THE INVENTION

The present invention relates in general to an apparatus and method which avoids the formation of indentations or humps in the pipe at the end of the bend and resists the bowing of the pipe in back of the bend die, resulting from the application of excessive force on the pressure die during operation of the rotary draw bending apparatus.

Accordingly, it is an object of the present invention to provide a rotary draw pipe bending apparatus comprising a bend die mounted for rotation about a bending axis; a clamp die directed toward the bend die for clamping a pipe to the bend die, the pipe having an inner surface engaged by the bend die and an outer surface engaged by the clamp die, the clamp die holding the pipe to be bent as the bend die and clamp die rotate about the bending axis; a pressure die engaged with an outer surface of the pipe for restraining a portion of the pipe spaced away from a bend to be formed in the pipe; and a reverse die engaged with an inner surface of the pipe at a location spaced from the clamp and bend dies and near the pressure die for resisting the bowing of the pipe in back of the bend die and for avoiding the formation of an indentation at the end of a bend to be formed in the pipe.

A further object of the invention is to provide a method of bending the pipe using rotary draw bending, which includes counteracting the force of the pressure die using a reverse die to resist the bowing of the pipe in back of the bend die and to avoid the formation of indentations in the pipe.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
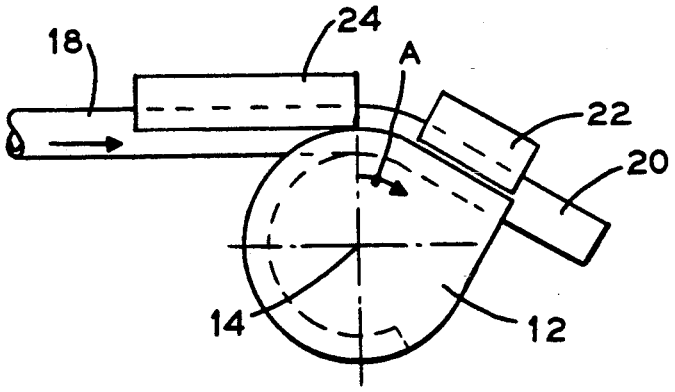
FIG. 1 (PRIOR ART)
FIG. 1 is a schematic side view of a rotary draw bending apparatus according to the prior art.

As shown in FIG. 1, the known rotary draw bending process involves clamping the pipe 20 between the clamp die 22 and the bend die 12 and engaging the outer surface 18 of pipe 20 next to the bend die 12 by a pressure die 24. As the clamp die 22 and the bend die 12 rotate in the direction of arrow A, around the bending axis 14, the pipe 20 moves in the direction of arrow B to accommodate the newly formed bend.

Figure 2:
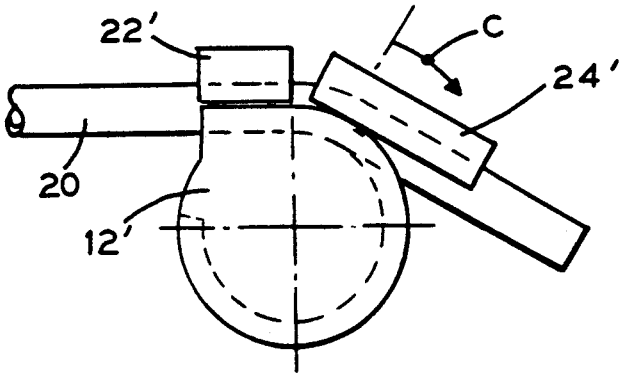
FIG. 2 (PRIOR ART)
FIG. 2 is a view similar to FIG. 1 showing a compression type bending apparatus according to the prior art.

FIG. 2 shows a known compression bending arrangement where the clamp die 22' holds the pipe 20 against a fixed bend die 12'. A movably mounted pressure die 24' moves in the direction of arrow C to form the bend in the pipe 20.

Figure 3:
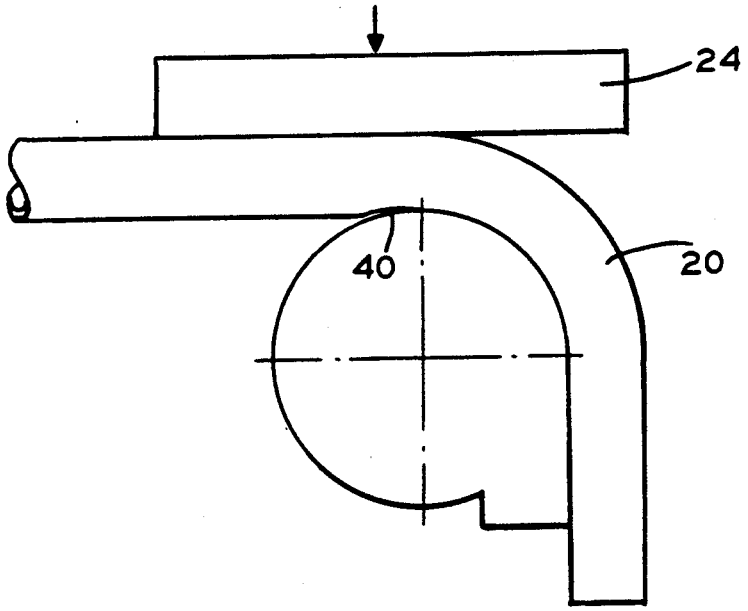
FIG. 3 (PRIOR ART)
FIG. 3 is a schematic side view showing an undesirable indentation in the pipe at the end of the bend, resulting from the application of excessive force on the pressure die of a prior art apparatus.

FIG. 3 shows the undesirable effect, encountered with the known apparatuses, whereby an indentation 40 is formed at one end of the bend whenever excessive force is applied on the pressure die 24 causing the latter to engage the pipe 20 too tightly.

Figure 4:
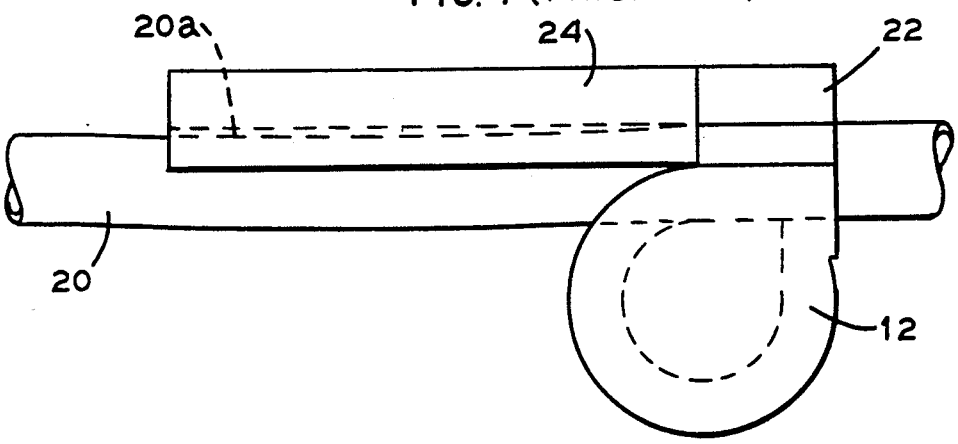
FIG. 4 (PRIOR ART)
FIG. 4 is a schematic side view showing an undesirable bowing of the pipe in back of the bend die resulting from the application of excessive force on the pressure die of a prior art apparatus.

FIG. 4 shows another undesirable effect, encountered with the known apparatuses, wherein the portion of pipe 20 positioned in back of the bend die 12 is deformed downwardly, as indicated by the phantom line 20*a*, by the downward pressure resulting from the application of excessive force on the pressure die 24.

Figure 5:
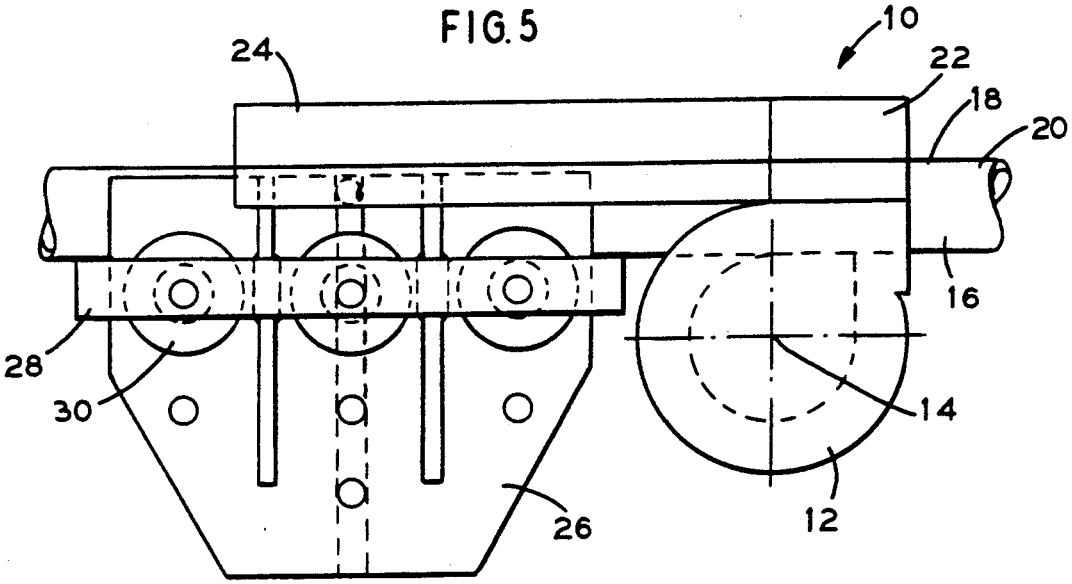
FIG. 5 is a schematic side view of an apparatus embodying the present invention.

FIG. 5 illustrates the invention and comprises a rotary draw bending apparatus 10 which includes a bend die 12 mounted for rotation about a bending axis 14. The bend die 12 has an outer surface engaging the inner surface 16 of a pipe 20 which is to be bent. The outer surface 18 of the pipe 20, near one end of the bend, is engaged by a clamp die 22 which holds the pipe 20 firmly to the outer surf ace of the bend die 12 and rotates therewith. A pressure die 24 is engaged with the outer surface 18 of the pipe 20 behind the bend area and is fixed with respect to the bend die 12 and clamp die 22.

According to the invention, a reverse pressure die 26 is engaged with the inner surface 16 of pipe 20, behind the bend area, and at least partly overlaps the pressure die 24 for counteracting the application of excessive force on the pressure die 24, thereby avoiding the undesirable indentations or humps in the pipe 20 at the end of the bend and resisting the bowing of pipe 20 in back of the bend die 12. The reverse pressure die 26 comprises a frame 28 which carries a plurality, in this case three, rollers 30 that engage the inner surface 16 of pipe 20. The reverse pressure die 26 can be repositioned to any desired location to counteract the force applied to the pressure die 24 thereby avoiding the indentation or hump 40 in the pipe 20 at the end of the bend, as shown in FIG. 3, and resisting the bowing of pipe 20 in back of the bend die 12, as shown in FIG. 4.

The use of a reverse pressure die in the rotary draw bending process, according to the present invention, provides the advantages of eliminating the indentation in the pipe at the end of the bend and resisting the bowing of the pipe in back of the bend die, improving the ovality of the pipe within the bend, allowing pipes having thinner walls to be bent, adding rigidity to the bending process, eliminating excessive wear of the bend die post and key ways and extending the life of other tools used in the bending process.

The apparatus of the present invention is particularly effective when used in the rotary draw bending machines utilized by the boiler tube industry. It should be recognized that the present invention is also readily adaptable in the manufacture of other products requiring the use of rotary draw bending machines.

While a specific embodiment of the invention has been shown and described in detail to illustrate the application of the principles of the invention, it will be understood that the invention may be embodied otherwise without departing from such principles.

What is claimed is:

1. A method for bending a pipe using a rotary draw bending technique and comprising:

engaging an inner surface of the pipe with a bend die mounted for rotation about a bending axis;

engaging an outer surface of the pipe with a clamp die for clamping the pipe to the bend die;

directing a pressure die against the outer surface of the pipe at a location spaced from the clamp and bend dies;

engaging a reverse die having a plurality of rollers with the inner surface of the pipe at a location opposite the pressure die; and rotating the clamp die and the bend die for bending the pipe.

2. A rotary draw pipe bending apparatus comprising a bend die mounted for rotation about a bending axis; a clamp die directed toward the bend die for clamping a pipe to the bend die, the pipe having an inner surface engaged by the bend die and an outer surface engaged by the clamp die, the clamp die holding the pipe to be bent as the bend die and clamp die rotate about the bending axis; a pressure die engaged with an outer surface of the pipe for restraining a portion of the pipe spaced away from the bend to be formed in the pipe; and a reverse die comprising a frame and a plurality of rollers rotatably mounted to the frame and engaged with an inner surface of the pipe at a location spaced from the clamp and bend dies and opposite the pressure die for resisting a bowing of the pipe and for avoiding the formation of an indentation at an end of the bend to be formed in the pipe.

* * * * *